US008814300B2

(12) United States Patent
Shin et al.

(10) Patent No.: US 8,814,300 B2
(45) Date of Patent: Aug. 26, 2014

(54) SYSTEM AND METHOD FOR SUB-PIXEL INK DROP ADJUSTMENT FOR PROCESS DIRECTION REGISTRATION

(75) Inventors: Helen HaeKyung Shin, Fairport, NY (US); David A. Mantell, Rochester, NY (US); Jeffrey J. Folkins, Rochester, NY (US); Patricia J. Donaldson, Pittsford, NY (US); John Gary Shaw, Victor, NY (US)

(73) Assignee: Xerox Corporation, Norwalk, CT (US)

( * ) Notice: Subject to any disclaimer, the term of this patent is extended or adjusted under 35 U.S.C. 154(b) by 106 days.

(21) Appl. No.: 13/550,230

(22) Filed: Jul. 16, 2012

(65) Prior Publication Data

US 2014/0015882 A1 Jan. 16, 2014

(51) Int. Cl.
*B41J 29/38* (2006.01)
*B41J 2/045* (2006.01)

(52) U.S. Cl.
CPC ..... *B41J 2/04588* (2013.01); *B41J 2/0459* (2013.01); *B41J 2/04591* (2013.01)
USPC ..... 347/10

(58) Field of Classification Search
CPC ... B41J 2/04588; B41J 2/0459; B41J 2/04591
USPC ..... 347/9–11, 14, 15, 19
See application file for complete search history.

(56) References Cited

U.S. PATENT DOCUMENTS

| | | | | |
|---|---|---|---|---|
| 5,410,414 | A | 4/1995 | Curry | |
| 5,600,351 | A | 2/1997 | Holstun et al. | |
| 5,638,107 | A | 6/1997 | Curry | |
| 5,742,325 | A | 4/1998 | Curry et al. | |
| 5,889,534 | A | 3/1999 | Johnson et al. | |
| 6,325,487 | B1 | 12/2001 | Mantell | |
| 6,346,993 | B1 | 2/2002 | Curry | |
| 6,411,399 | B1 | 6/2002 | Mantell et al. | |
| 6,493,106 | B1 | 12/2002 | Gauthier et al. | |
| 6,604,812 | B2 * | 8/2003 | Askeland et al. | 347/40 |
| 6,695,426 | B2 | 2/2004 | Herwald et al. | |
| 6,764,156 | B2 | 7/2004 | Mantell | |
| 7,300,131 | B2 | 11/2007 | Sakagami et al. | |
| 7,518,618 | B2 | 4/2009 | Loce et al. | |
| 7,673,969 | B2 | 3/2010 | Hoisington et al. | |
| 7,770,991 | B2 | 8/2010 | Reinten et al. | |
| 7,871,145 | B1 | 1/2011 | Enge | |
| 7,926,900 | B2 | 4/2011 | Srinivasan et al. | |
| 2002/0180830 | A1 | 12/2002 | Askeland et al. | |
| 2008/0150995 | A1 | 6/2008 | Srinivasan et al. | |
| 2009/0096823 | A1 | 4/2009 | Watt et al. | |
| 2010/0156987 | A1 | 6/2010 | Yip et al. | |
| 2011/0242186 | A1 | 10/2011 | Mizes et al. | |

* cited by examiner

*Primary Examiner* — An Do
(74) *Attorney, Agent, or Firm* — Maginot, Moore & Beck, LLP

(57) ABSTRACT

A method of operating an inkjet printer reduces ink drop placement errors in a process direction. The method includes generating firing signals for inkjets in a printhead at a first frequency and initiating the generation of the firing signals to a first plurality of inkjets in the printhead at a second frequency, the first frequency being greater than the second frequency.

20 Claims, 7 Drawing Sheets

SYSTEM AND METHOD FOR SUB-PIXEL INK DROP ADJUSTMENT FOR PROCESS DIRECTION REGISTRATION

TECHNICAL FIELD

This disclosure relates generally to control of the placement of ink drops in a printed image, and, more particularly, to control of the position of ink drops in a process direction during inkjet printing.

BACKGROUND

A typical inkjet printer uses one or more printheads to form an ink image on an image receiving surface. Each printhead typically contains an array of individual inkjets for ejecting drops of ink across an open gap to an image receiving surface to form an image. The image receiving surface may be the surface of a continuous web of recording media, a series of media sheets, or the surface of a rotating image receiving member, such as a print drum or endless belt. Images printed on a rotating image receiving member are later transferred to recording media by mechanical force in a transfix nip formed by the rotating surface and a transfix roller. In an inkjet printhead, individual piezoelectric, thermal, or acoustic actuators generate mechanical forces that expel ink through an orifice from an ink filled conduit in response to an electrical voltage signal, sometimes called a firing signal. The amplitude, frequency, and/or duration of the signals affect the amount of ink ejected in each drop. The firing signal is generated by a printhead controller with reference to digital image data. An inkjet printer forms a printed image in accordance with the image data by printing a pattern of individual ink drops at particular locations on the image receiving member. The locations where the ink drops landed are sometimes called "ink drop locations," "ink drop positions," or "pixels." Thus, a printing operation can be viewed as the placement of ink drops on an image receiving member with reference to the digital image data.

In order for the printed images to correspond closely to the image data, both in terms of fidelity to the image objects and in the colors represented by the image data, the printheads must be registered with reference to the imaging surface and with the other printheads in the printer. While existing techniques can be used to detect errors in the placement of ink drops on the image receiving member, the correction of ink drop placement errors can present challenges. To correct process direction errors, the printer adjusts a timing offset used to control when firing signals are delivered to particular inkjets. In an existing printer, the inkjets in a printhead operate in a synchronous manner at a predetermined frequency. During each cycle of the frequency, an inkjet can either eject an ink drop in response to receiving an electrical firing signal from a controller, or not eject an ink drop when the controller does not deliver a firing signal. The resolution of images printed by the inkjet in the process direction is affected by the predetermined frequency and the velocity of the image receiving member. For example, if the printhead is operated with a frequency of 13 KHz, then an inkjet can eject up to 13,000 ink drops per second. If the image receiving member moves past the inkjet at a rate of approximately 37.14 inches per second, then the inkjet can form a line of ink drops in the process direction with a resolution of 350 drops per inch, where each drop lands to form a pixel on the image receiving surface.

Inkjets do not always operate flawlessly. The trajectory of ink drops ejected from an inkjet do not always fly true from the aperture to the image receiving surface. In fact, the paths traveled by ink drops ejected by an inkjet vary with the frequency at which the inkjet is fired, the frequency, duration, and/or amplitude of the firing signal that activates the actuator, the number of cycles that the inkjet has been inactive before the inkjet is activated, as well as other factors. Known printers operate inkjets to form test patterns on image receiving surfaces, generate image data of those patterns on the surface, and analyze those patterns to quantify errors in the position of the ejected ink drops, particularly first ink drops ejected after a relative period of inactivity and last drops ejected in sequence of contiguous inkjet firings. Once these errors are quantified, a controller can delay or expedite the delivery of a firing signal to alter the location where an ink drop lands in the process direction. These adjustments, however, can be no finer than a single pixel. That is, the smallest adjustment is either to operate the inkjet as if to cause the inkjet to eject the ink drop on the preceding row with the result that the ink drop is closer to the intended position due to the quantified error or to operate the inkjet as if to cause the inkjet to eject the ink drop on the next row with the result that the ink drop is closer to the intended position due to the quantified error in the opposite direction. While such an adjustment can help correct larger errors in the placement of ink drops, drop placement errors may still be noticeable. For example, an adjustment of one pixel in the process direction can overcompensate for an identified error and produce a new error.

One solution to improve the precision of ink drop placement is simply to operate the inkjets in the printhead at a much higher frequency for higher-resolution printing that enables finer compensation of drop placement errors. The operating characteristics of many printheads, however, render this solution impractical for many printers. For example, various fluidic, mechanical and physical characteristic of the inkjets in a given printhead mean that the individual inkjets can generally only be fired at a given maximum frequency. At rates greater than this maximum frequency, some of the inkjets in the printhead begin misfiring or producing inconsistencies in ink drop size and placement. Additionally most printheads synchronize the operation of the inkjets with an external trigger signal instead of operating the individual inkjets independently. In light of the operational limitations of printheads, improvements to the operation of inkjet printers to reduce errors in ink drop placement would be beneficial.

SUMMARY

In one embodiment, a method of operating an inkjet printer with reduced error in process direction ink drop placement has been developed. The method includes generating firing signals for inkjets in a printhead, the firing signals corresponding to a first frequency, and initiating the generation of the firing signals to a first plurality of inkjets in the printhead at a second frequency, the first frequency being greater than the second frequency.

In another embodiment, an inkjet printer that is configured to eject ink drops with reduced drop placement error in a process direction has been developed. The printer includes an image receiving member having an image receiving surface, a printhead including a plurality of inkjets, each inkjet in the plurality of inkjets being configured to eject an ink drop onto the image receiving surface in response to a firing signal, a printhead controller operatively connected to the plurality of inkjets in the printhead, an actuator configured to move the image receiving surface past the printhead in a process direction, and a controller operatively connected to the printhead controller, actuator, and a memory. The printhead controller is configured to generate firing signals for inkjets in a printhead with reference to rendered image data, the firing signals corresponding to a first frequency, and initiate the generation of firing signals to a first plurality of the inkjets in the printhead at a second frequency, the first frequency being greater than the second frequency. The controller is configured to operate the actuator to move the image receiving surface past the printhead in the process direction at a predetermined rate, and send the rendered image data to the printhead controller.

BRIEF DESCRIPTION OF THE DRAWINGS

The foregoing aspects and other features of a printer that operates a printhead to compensate for process direction ink drop placement errors are explained in the following description, taken in connection with the accompanying drawings.

DETAILED DESCRIPTION

Figure 1:
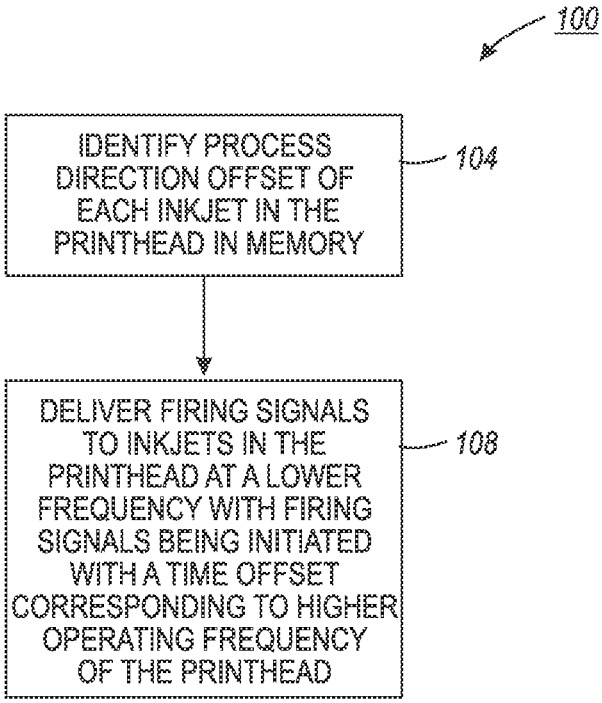
FIG. 1 is a block diagram of a process for operating a printhead to improve the accuracy of ink drop placement in a process direction for a predetermined print resolution.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that produces images with colorants on media, such as digital copiers, bookmaking machines, facsimile machines, multi-function machines, etc.

As used herein, the term "pixel" refers to a single location in a two-dimensional arrangement of image data corresponding to an ink image that an inkjet printer forms on an image receiving surface. The locations of pixels in the image data correspond to locations of ink drops on the image receiving surface that form the ink image when multiple inkjets in the printer eject ink drops with reference to the image data. The pixel locations on the image receiving surface have dimensions corresponding to the resolution of the printed image in the process direction. The term "sub-pixel" refers to a dimension that is smaller than the size of a pixel in the process direction on the image receiving member. A sub-pixel adjustment to a registration of an ink drop moves the ink drop by a distance that is less than full size of a pixel in the printed image at a particular process direction resolution. For example, a sub-pixel adjustment of ⅓ of a pixel corresponds to moving an ink drop in the process direction by a distance of ⅓ the nominal size of a pixel at a given resolution, which enables a three-fold increase in the precision of pixel placement. An inkjet printer forms ink images by selectively ejecting ink drops corresponding to the activated pixels in the image data. A multicolor printer ejects ink drops of different ink color with reference to separate sets of binary image data for each of the different colors to form multicolor ink images.

As used herein, the term "activated pixel" refers to a pixel value in the image data that causes the printer to eject a drop of ink onto an image receiving surface location corresponding to the activated pixel. The term "deactivated pixel" refers to a pixel value in the image data having a value that does not cause the printer to eject a drop of ink onto an image receiving surface location. The term "sub-pixel" refers to a dimension that is smaller than the size of a pixel on the image receiving member at a particular process direction resolution. A sub-pixel adjustment to a registration of an ink drop moves the ink drop by a distance that is less than full size of a pixel in the printed image. For example, a sub-pixel adjustment of ⅓ of a pixel corresponds to moving an ink drop by a distance of ⅓ the nominal size of a pixel at a given resolution. An inkjet printer forms ink images by selectively ejecting ink drops corresponding to the activated pixels in the image data. A multicolor printer ejects ink drops of different ink color with reference to separate sets of binary image data for each of the different colors to form multicolor ink images.

As used herein, the term "process direction" refers to a direction of travel of an image receiving member relative to one or more printheads in a print zone to receive a printed ink image. The term "cross-process" direction refers to a direction that is perpendicular to the process direction along the surface of the image receiving member. In an inkjet printer, an ink image is typically formed as a series of ink drops that are formed as lines extending in the cross-process direction. As the image receiving member moves in the process direction, the inkjets in the printheads form a series of the ink drop lines that form a two-dimensional ink image. The term "process direction registration" refers to the alignment of ink drops that are intended to be formed in one line extending in the cross-process direction on the image receiving member. When the printer operates all of the inkjets with correct process registration to form the line, the ink drops ejected from the inkjet form a line that is substantially straight and parallel to the cross-process direction. However, variations in manufacturing and other tolerances within a printhead can lead to variations in ejected ink drop velocities and/or angles of ejection. The variations between the drop positions of ink drops ejected from different inkjets can, therefore, result in process direction errors where some ink drops are not co-linear with other ink drops on the image receiving member. As described below, adjustments to the operation of the printer can reduce or eliminate process direction registration errors in printed images.

As used herein, the terms "operating signal" and "clock signal" are used interchangeably and refer to a signal with a predetermined average frequency that is used to synchronize operations of a component in a printer. Examples of such components include digital logic circuits in printheads and piezoelectric or thermal ejectors that eject individual ink drops from an inkjet in a printhead. Operations of the components are typically synchronized with either or both of a rising edge and a falling edge of the clock signal to enable precise timing of the operation of printer components.

Figure 4:
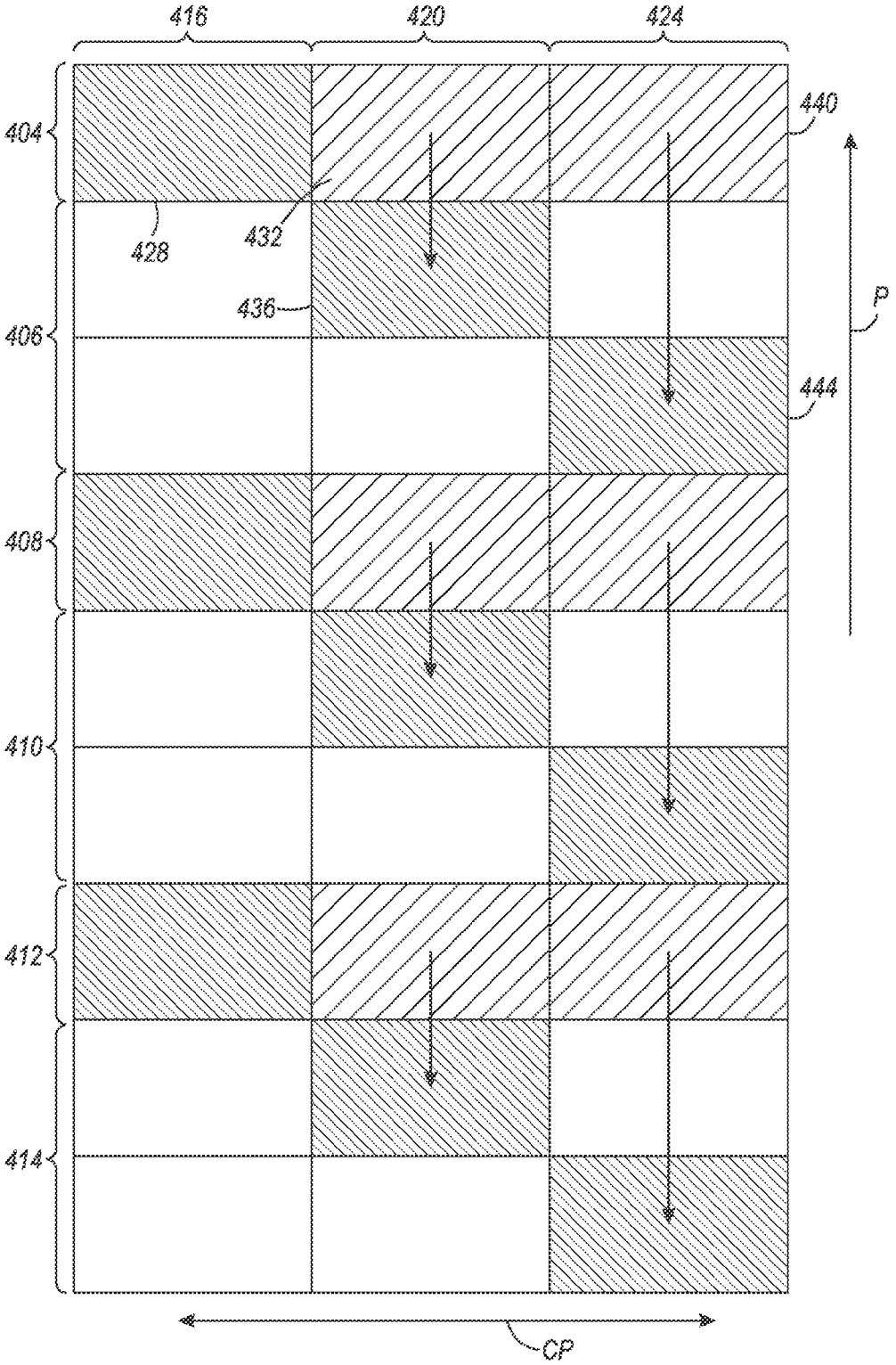
FIG. 4 is a depiction of image data corresponding to inkjets in a printhead to register printed ink drops in the process direction.

FIG. 4 depicts a prior-art inkjet printer 5. For the purposes of this disclosure, an inkjet printer employs one or more inkjet printheads to eject drops of ink onto an image receiving member, such as paper, another print medium, or an indirect member such as a rotating image drum or belt. The printer 5 is configured to print ink images with a "phase-change ink," by which is meant an ink that is substantially solid at room temperature and that transitions to a liquid state when heated to a phase change ink melting temperature for jetting onto the imaging receiving member surface. The phase change ink melting temperature is any temperature that is capable of melting solid phase change ink into liquid or molten form. In one embodiment, the phase change ink melting temperature is approximately 70° C. to 140° C. In alternative embodiments, the ink utilized in the printer comprises UV curable gel ink. Gel inks are also heated before being ejected by the inkjet ejectors of the printhead. As used herein, liquid ink refers to melted phase change ink, heated gel ink, or other forms of ink, such as aqueous inks, ink emulsions, ink suspensions, ink solutions, or the like.

The printer 5 includes a controller 50 to process the image data before generating the control signals for the inkjet ejectors to eject colorants. Colorants can be ink, or any suitable substance that includes one or more dyes or pigments and that is applied to the selected media. The colorant can be black, or any other desired color, and some printer configurations apply a plurality of distinct colorants to the media. In the configuration of FIG. 4, the printer 5 ejects cyan, magenta, yellow, and black (CMYK) inks onto the media web to form color ink images. The media includes any of a variety of substrates, including plain paper, coated paper, glossy paper, or transparencies, among others, and the media can be available in sheets, rolls, or other physical formats.

The printer 5 is an example of a direct-to-sheet, continuous-media, phase-change inkjet printer that includes a media supply and handling system configured to supply a long (i.e., substantially continuous) web of media 14 of "substrate" (paper, plastic, or other printable material) from a media source, such as spool of media 10 mounted on a web roller 8. For simplex printing, the printer 5 passes the media web 14 through a media conditioner 16, print zone 20, and rewind unit 90 once. In the simplex operation, the media source 10 has a width that substantially covers the width of the rollers over which the media travels through the printer.

For duplex operations, the web inverter 84 flips the media web 14 over to present a second side of the media to the print zone 20 before being taken up by the rewind unit 90. In duplex operation, the media source is approximately one-half of the roller widths as the web travels over one-half of the surface of each roller 26 in the print zone 20. The inverter 84 flips and laterally displaces the media web 14 and the media web 14 subsequently travels over the other half of the surface of each roller 26 opposite the print zone 20 for printing and conditioning of the reverse side of the media web 14. The rewind unit 90 is configured to wind the web onto a roller for removal from the printer and subsequent processing.

In another duplex printing configuration, two printers with the configuration of the printer 5 are arranged serially with a web inverter interposed between the two printers to perform duplex printing operations. In the serial printing arrangement, the first printer forms and fixes an image on one side of a web, the inverter turns the web over, and the second printer forms and fixes an image on the second side of the web. In the serial duplex printing configuration, the width of the media web 14 can substantially cover the width of the rollers in both printers over which the media travels during duplex printing.

The media web 14 is unwound from the source 10 as needed and a variety of motors, not shown, rotate one or more rollers 12 and 26 to propel the media web 14. The media conditioner includes rollers 12 and a pre-heater 18. The rollers 12 and 26 control the tension of the unwinding media as the media moves along a path through the printer. In alternative embodiments, the printer transports a cut sheet media through the print zone in which case the media supply and handling system includes any suitable device or structure to enable the transport of cut media sheets along a desired path through the printer. The pre-heater 18 brings the web to an initial predetermined temperature that is selected for desired image characteristics corresponding to the type of media being printed as well as the type, colors, and number of inks being used. The pre-heater 18 can use contact, radiant, conductive, or convective heat to bring the media to a target preheat temperature, which in one practical embodiment, is in a range of about 30° C. to about 70° C.

The media is transported through a print zone 20 that includes a series of color printhead modules or units 21A, 21B, 21C, and 21D, each printhead unit effectively extends across the width of the media and is able to eject ink directly (i.e., without use of an intermediate or offset member) onto the moving media. In printer 5, each of the printheads ejects a single color of ink, one for each of the colors typically used in color printing, namely, cyan, magenta, yellow, and black (CMYK) for printhead units 21A, 21B, 21C, and 21D, respectively.

The controller 50 of the printer receives velocity data from encoders mounted proximately to rollers positioned on either side of the portion of the path opposite the four printheads to calculate the linear velocity and position of the web as the web moves past the printheads. The controller 50 uses these data to generate firing signals for actuating the inkjet ejectors in the printheads to enable the printheads to eject four colors of ink with appropriate timing and accuracy for registration of the differently colored patterns to form color images on the media. The inkjet ejectors actuated by the firing signals correspond to digital data processed by the controller 50.

The digital data for the images to be printed can be transmitted to the printer, generated by a scanner (not shown) that is a component of the printer, or otherwise generated and delivered to the printer. In various configurations, a color unit for each primary color includes one or more printheads; multiple printheads in a module are formed into a single row or multiple row array; printheads of a multiple row array are staggered; a printhead prints more than one color; or the printheads or portions thereof are mounted movably in a direction transverse to the process direction P for printing operations, such as for spot-color applications and the like. While the printhead units in the printer 5 are configured to eject liquid drops of a phase change ink onto the media web 14, a similar configuration of inkjets that print solvent inks, aqueous inks, or any other liquid ink can be used to generate ink images as described herein.

Associated with each color unit is a backing member 24A-24D, typically in the form of a bar or roll, which is arranged substantially opposite the printhead on the back side of the media. Each backing member positions the media at a predetermined distance from the printhead opposite the backing member. The backing members 24A-24D are optionally configured to emit thermal energy to heat the media to a predetermined temperature, which is in a range of about 40° C. to about 60° C. in printer 5. The various backer members can be controlled individually or collectively. The pre-heater 18, the printheads, backing members 24A-24D (if heated), as well as the surrounding air combine to maintain the media along the portion of the path opposite the print zone 20 in a predetermined temperature range of about 40° C. to 70° C.

As the partially-imaged media web 14 moves to receive inks of various colors from the printheads of the print zone 20, the printer 5 maintains the temperature of the media web within a given range. The printheads in the color units 21A-21D eject ink at a temperature typically significantly higher than the temperature of the media web 14. Consequently, the ink heats the media, and temperature control devices can maintain the media web temperature within a predetermined range. For example, the air temperature and air flow rate behind and in front of the media web 14 impacts the media temperature. Accordingly, air blowers or fans can be utilized to facilitate control of the media temperature. Thus, the printer 5 maintains the temperature of the media web 14 within an appropriate range for the jetting of all inks from the printheads of the print zone 20. Temperature sensors (not shown) can be positioned along this portion of the media path to enable regulation of the media temperature.

Following the print zone 20 along the media path are one or more "mid-heaters" 30. A mid-heater 30 can use contact, radiant, conductive, and/or convective heat to control a temperature of the media. The mid-heater 30 brings the ink placed on the media to a temperature suitable for desired properties when the ink on the media is sent through the spreader 40. In one embodiment, a useful range for a target temperature for the mid-heater is about 35° C. to about 80° C. The mid-heater 30 has the effect of equalizing the ink and substrate temperatures to within about 15° C. of each other. Lower ink temperature gives less line spread while higher ink temperature causes show-through (visibility of the image from the other side of the print). The mid-heater 30 adjusts substrate and ink temperatures to 0° C. to 20° C. above the temperature of the spreader.

Following the mid-heaters 30, a fixing assembly 40 applies heat and/or pressure to the media to fix the images to the media. The fixing assembly includes any suitable device or apparatus for fixing images to the media including heated or unheated pressure rollers, radiant heaters, heat lamps, and the like. In the embodiment of the FIG. 4, the fixing assembly includes a "spreader" 40, that applies a predetermined pressure, and in some implementations, heat, to the media. The function of the spreader 40 is to flatten the individual ink droplets, strings of ink droplets, or lines of ink on web 14 and flatten the ink with pressure and, in some systems, heat. The spreader flattens the ink drops to fill spaces between adjacent drops and form uniform images on the media web 14. In addition to spreading the ink, the spreader 40 improves fixation of the ink image to the media web 14 by increasing ink layer cohesion and/or increasing the ink-web adhesion. The spreader 40 includes rollers, such as image-side roller 42 and pressure roller 44, to apply heat and pressure to the media. Either roller can include heat elements, such as heating elements 46, to bring the web 14 to a temperature in a range from about 35° C. to about 80° C. In alternative embodiments, the fixing assembly spreads the ink using non-contact heating (without pressure) of the media after the print zone 20. Such a non-contact fixing assembly can use any suitable type of heater to heat the media to a desired temperature, such as a radiant heater, UV heating lamps, and the like.

In one practical embodiment, the roller temperature in spreader 40 is maintained at an optimum temperature that depends on the properties of the ink, such as 55° C. Generally, a lower roller temperature gives less line spread while a higher temperature produces imperfections in the gloss of the ink image. Roller temperatures that are too high may cause ink to offset to the roll. In one practical embodiment, the nip pressure is set in a range of about 500 to about 2000 psi. Lower nip pressure produces less line spread while higher pressure may reduce pressure roller life.

The spreader 40 can include a cleaning/oiling station 48 associated with image-side roller 42. The station 48 cleans and/or applies a layer of some release agent or other material to the roller surface. The release agent material can be an amino silicone oil having viscosity of about 10-200 centipoises. A small amount of oil transfers from the station to the media web 14. with the printer 5 transferring approximately 1-10 mg per A4 sheet-sized portion of the media web 14. In one embodiment, the mid-heater 30 and spreader 40 are combined into a single unit, with their respective functions occurring relative to the same portion of media simultaneously. In another embodiment the media is maintained at a high temperature as the media exits the print zone 20 to enable spreading of the ink.

Following passage through the spreader 40 the printed media can be wound onto a roller for removal from the system (simplex printing) or directed to the web inverter 84 for inversion of the print medium and displacement to another section of the rollers for a second pass by the printheads, mid-heaters, spreader, and coating station. One configuration of the printer 5 winds the simplex or duplex printed media onto a roller for removal from the system by rewind unit 90. Alternatively, the media can be directed to other processing stations that perform tasks such as cutting, binding, collating, and/or stapling the media or the like.

In printer 5, the controller 50 is operatively connected to various subsystems and components to regulate and control operation of the printer 5. The controller 50 is implemented with general or specialized programmable processors that execute programmed instructions. A memory 52 stores programmed instructions and also stores various data used in the configuration and operation of the printer 5. As described below, the memory 52 stores image data corresponding to images to be printed on the media web 14 with printheads in the color units 21A-21D. The controller 50 also includes at least one clock generator that generates clock signals at various frequencies. The clock generator can include one or more oscillators, clock multipliers, and frequency dividers to enable generation of clock signals over a wide range of operating frequencies. The generated clock signals are used to control the operation of printheads and inkjets in the color units 21A-21D along with various synchronous logic devices and processors in the controller 50.

The processors, their memories, and interface circuitry configure the controller 50 and/or print engine to perform the printer operations. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, FPGAs, discrete components, or VLSI circuits. The controller 50 is operatively connected to the print bar and printheads in the color units 21A-21D in order to generate electrical firing signals for operation of the inkjets to form ink images on the media web 14.

Each printhead in the color units 21A-21D includes an individual printhead controller that generates firing signals in response to rendered image data received from the controller 50. The printhead controllers are configured to generate firing signals that enable the inkjets to operate at a first frequency, but each inkjet only receives a firing signal at a second frequency that is less than the first frequency. For example, the printhead controller can be configured to generate firing signals that enable the inkjets to eject ink drops at a frequency of 39 KHz, but each inkjet in the printhead receives firing signals at rate of only 13 Khz. By generating firing signals having a frequency that is greater than the rate at which firing signals are delivered to the inkjets, the positioning of the ink drops can be achieved with sub-pixel precision in the process direction.

In one embodiment, the printhead controller in each printhead includes a memory that stores a numeric offset value for each inkjet in the printhead. In this embodiment, the controller 50 sends to a printhead controller the rendered image data to be printed by the inkjets in the printhead(s) operatively connected to the printhead controller. The printhead controller then generates a firing signal for each inkjet that ejects an ink drop corresponding to pixels in the rendered data. This firing signal operates the inkjet at a first frequency, but then the delays stored for each inkjet are used to deliver the firing signal to each inkjet. Thus, some of the inkjets receive the firing signal after no delay, some receive the firing signal after one delay period, and some receive the firing signal after two delay periods in the example above where the first frequency is 39 KHz and the second frequency is 13 KHz. Even if none of the inkjets have a delay stored for them, the inkjets all fire without delay, but the printhead controller waits for two more delay periods before operating the inkjets again with reference to the next set of rendered image data.

Figure 7:
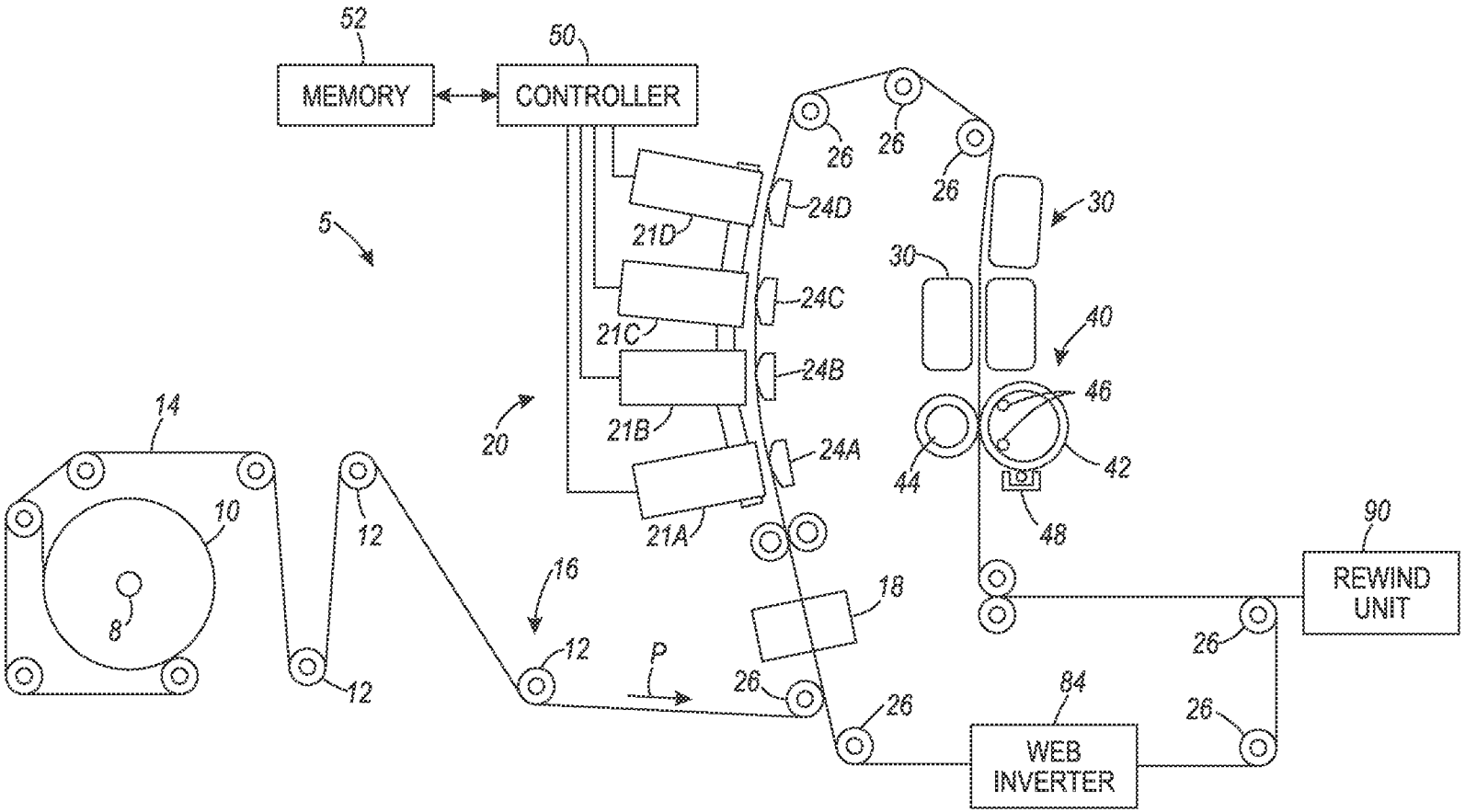
FIG. 7 PRIOR ART
FIG. 7 is a prior art diagram of an inkjet printer.

The imaging system 5 of FIG. 7 is merely illustrative of one embodiment of an imaging system that forms ink images on a print medium with sub-pixel process direction registration between inkjets in the printer. Alternative imaging systems include, but are not limited to, sheet fed imaging systems, indirect inkjet printers that form latent ink images on a drum or belt prior to transferring the ink image to a print medium, and inkjet printers that use liquid inks instead of phase change inks.

FIG. 1 depicts a process 100 for operating inkjets in a printhead to produce printed images with reduced drop-placement error in the process direction. In the discussion below, a reference to the process performing a function or action refers to a controller executing programmed instructions stored in a memory to operate one or more components to perform the function or action. The process 100 is described in conjunction with the printer 5 of FIG. 7 and timing diagrams 202A, 202B, and 202C in FIG. 2 for illustrative purposes.

Process 100 begins with identification of a process direction offset value corresponding to each inkjet in the printhead (block 104). In the printer 5, the offset values are stored in the memory 52 in association with each printhead and inkjet in the color units 21A-21D. In the example of the printer 5, the offset values are integer numbers that correspond to a number of clock cycles of an operating frequency of the printhead to achieve a predetermined resolution in the process direction. The controller 50 modifies the time of firing signal generation for the individual inkjets in the printhead with reference to the offset value. The offset values can be identified using printhead registration processes that are known to the art for detection of process direction registration errors between inkjets in the printhead and between multiple printheads in the color units 21A-21D. The offset value for each inkjet in the printhead is stored in the memory 52 during the registration process for later use with process 100. In a configuration of the printer 5 that includes individual printhead controllers, the offset values can be stored in individual memories that are associated with each printhead in the color units 21A-21D.

In process 100, the controller delivers the rendered image data to inkjets in the printhead at a first predetermined frequency with reference to the identified offset for each inkjet. The printhead controller then operates the inkjets in the printhead corresponding with the delivered image data with a firing signal having frequency that is higher than the frequency at which the image data are delivered for the inkjets having the identified offset (block 108). In the printer 5, the controller 50 delivers rendered image data for the inkjets having no delay offset to the printhead controllers in the color units 21A-21D at a first frequency that is less than the frequency of the firing signals that the printhead controller generates to drive the inkjets in the printheads. The controller 50 then delivers the rendered image data for the one delay offset inkjets, then the two delay offset inkjets, and so on until the controller reaches the time to deliver the next set of image data to the inkjets having no delay offsets. The frequency at which the rendered data are delivered for each group of inkjets corresponding to one of the delay offsets is selected with reference to various factors including the design of the inkjets in the printhead, the resolution of the printed images, and the selected throughput of the printer.

The controller 50 delivers the rendered image data for each group of inkjets in a printhead at a lower frequency than the inkjet firing signal frequency. For example, in the printer 5 the controller 50 delivers the rendered image data to each printhead controller at a frequency of 13 KHz or 19.5 KHz. In some embodiments, the frequency of the firing signal used to operate the printhead is an integer multiple of the frequency at which the controller delivers the rendered image data to printhead controller. For example, in the printer 5 the controller 50 delivers rendered image data for each delay offset group of inkjets in a printhead at frequency of 13 KHz. The frequency of the firing signal for the inkjets in the printhead is 39 KHz. In another configuration, the controller 50 delivers the rendered image data to the printhead controller at frequency of 19.5 KHz, while the firing signal for the inkjets in the printheads operatively connected to the printhead controller is 39 KHz. The difference between the lower frequency at which the rendered image data are delivered and the higher frequency of the inkjet firing signal enables more accurate ink drop placement in the process direction.

Figure 6:
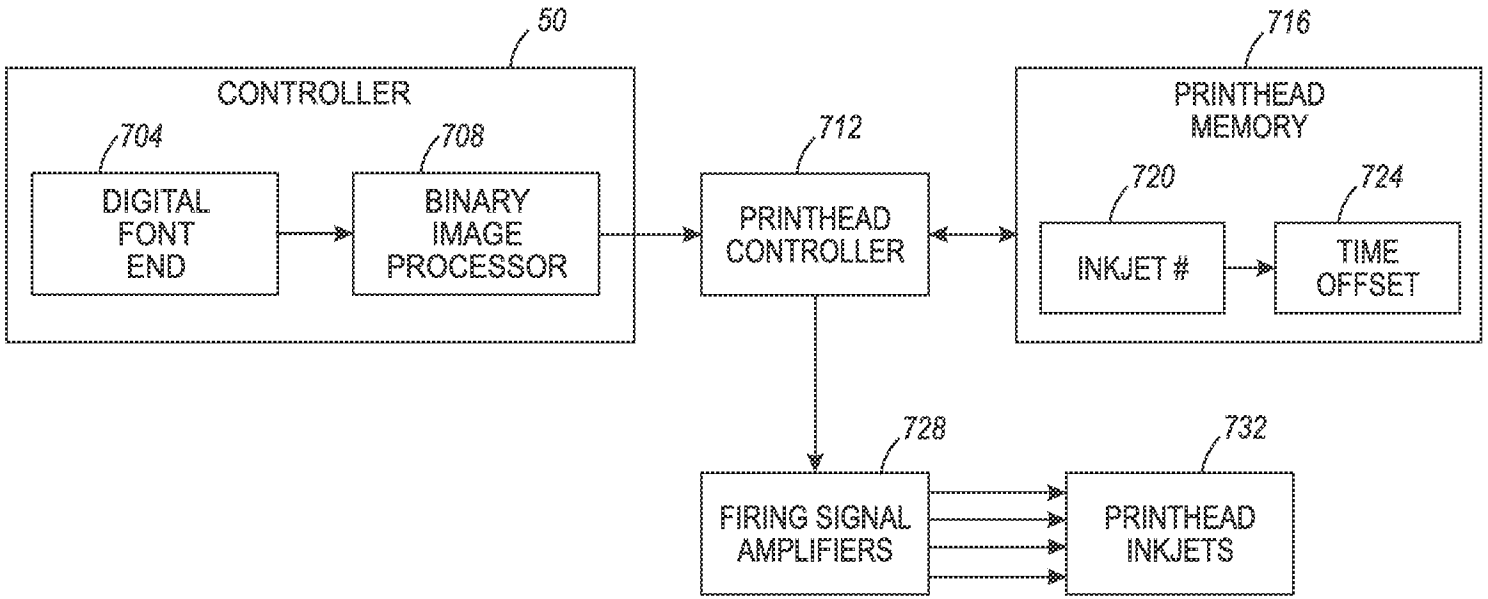
FIG. 6 is a schematic diagram of a controller associated with a single printhead in an inkjet printer that is configured to operate the printhead with reference to binary image data.

FIG. 6 depicts the controller 50 and an individual printhead controller 712 schematically. In FIG. 6, the controller 50 implements a digital front end (DFE) 704 and a binary image processor 708. The controller 50 is operatively connected to a printhead controller 712 that is associated with each color unit in the printer 5. The printhead controller 712 receives rendered binary image data from the controller 50 and controls the generation of electrical firing signals with the firing signal amplifiers 728. The signals from the firing signal amplifiers 728 activate the individual inkjets 732 in each printhead of a color unit.

In the controller 50, the DFE 704 and binary image processor 708 can be implemented as software modules, customized hardware modules, or a combination of hardware and software modules. In the controller 50, the DFE 704 processes image data in a variety of formats including, but not limited to, rasterized graphics formats and image data encoded in a page description language (PDL). The DFE processes the image data and the binary image processor 708 generates two-dimensional image data to control inkjets for each of the color separation in printer. For example, the binary image processor 708 generates a two-dimensional arrangement of pixels that are either activated or deactivated for each printhead in the color units 21A-21D. The binary image processor 708 generates four different sets of binary image data corresponding to each of the CMYK colors that are used in the printer 5.

The printhead controller 712 is associated with either a single printhead or with a group of multiple printheads. During operation, the printhead controller 712 receives binary image data from the binary image processor 708. In one embodiment, the controller 50 and the binary image processor 708 are configured to modify the delivery of rendered image data to the printhead controller 712 so that the printhead controller 712 receives binary image data corresponding to only a portion of the inkjets 732 that eject ink drops to form a printed line. For example, if the printhead controller 712 is configured to deliver firing signals to each inkjet in the printhead at a maximum frequency of 13 KHz while the printhead controller 712 operates the amplifiers to generate firing signals having a frequency of 39 KHz, then the binary image processor 708 is configured to deliver only one-third of the rendered image data corresponding to each line in the original binary image data to the printhead controller 712 during each clock cycle. The binary image processor 708 selects the image data to send to the printhead controller 712 during each clock cycle with reference to predetermined offset values corresponding to each of the printhead inkjets 732.

In another configuration that is described in more detail below, the binary image processor interleaves rows of deactivated pixels between the original rasterized binary image data and then selectively shifts columns of the interleaved image data in the process direction with reference to the offset value stored for each of the inkjets 732. The printhead controller 712 receives one row of the interleaved image data during each cycles of the higher operating clock frequency, and generates firing signals for a portion of the inkjets that are included in each of the interleaved rows of image data.

In another configuration, a printhead controller memory 716 stores a plurality of identifiers 720 corresponding to the individual inkjets in the printhead, and an associated time offset 724 for each inkjet. In this configuration, the binary image processor 708 in the controller 50 sends rendered binary image data to the printhead controller 712 at the same frequency of the operation of the inkjets 732, such as 13 KHz. Again, the amplifiers generate a firing signal for the inkjets at a higher frequency, such as 39 KHz. For each set of rendered image data that arrive at the 13 KHz frequency, the printhead controller 712 selects a time offset value 724 from the memory 716 corresponding to the inkjets 720 that eject ink drops for activated pixels in the binary image data. The printhead controller 712 initiates the amplifiers to generate the firing signals for the printhead inkjets 732 with reference to the time offset value 724 for each inkjet. For example, the controller 712 operates the amplifiers to generate firing signals for the inkjets 732 during one of three cycles of the 39 KHz clock signal for each of the printhead inkjets 732 for a single set of rendered binary image data.

In each of the configurations described above, the printhead controller 712 only operates each individual inkjet a maximum of one time for each row of the original rendered binary image data. Thus, the printhead controller 712 only delivers firing signals to an individual inkjet in the printhead inkjets 732 at the lower 13 KHz frequency, while each inkjet in the printhead 732 is operated with a firing signal having a frequency of 39 KHz to adjust the process direction location of ink drops from different inkjets in the printhead.

Figure 2:
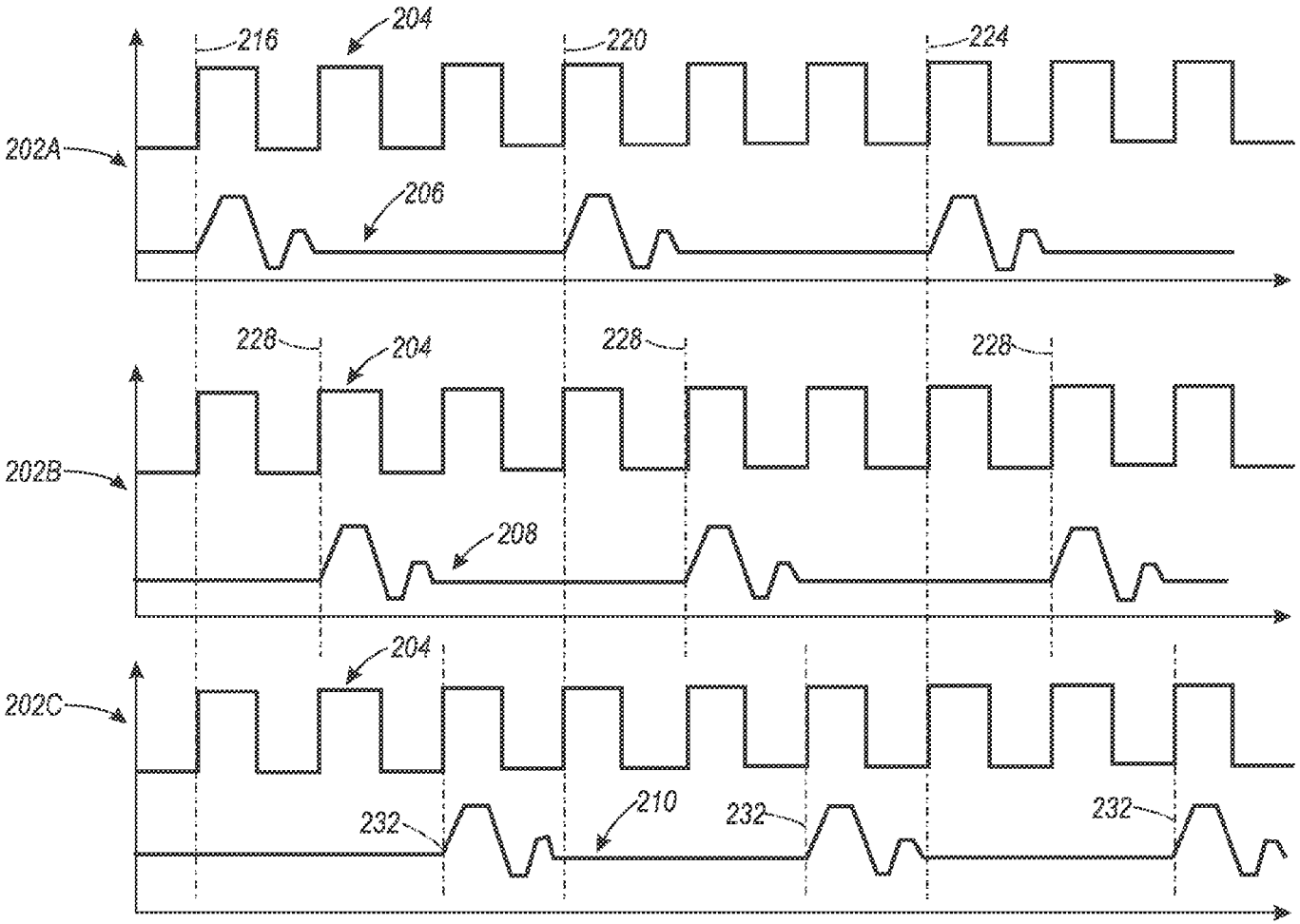
FIG. 2 is a timing diagram depicting firing signals generated for inkjets in a printhead to register printed ink drops in a process direction.

FIG. 2 depicts timing diagrams corresponding to the firing signals and clock signals used for delivery of the rendered image data in process 100. FIG. 2 depicts timing diagrams 202A, 202B, and 202C corresponding to three series of firing signals 206, 208, and 210, respectively. Each of the firing signal series 206, 208, and 210 depicts the firing signals that are delivered to the inkjets in a printhead that correspond to one particular delay offset. In FIG. 2, three delay offsets of 0, 1, or 2 periods of the clock signal 204 are possible. In receipt of the rendered image data corresponding to the zero delay offset, the firing signal 206 is generated. In receipt of the rendered image data corresponding to one delay offset, the firing signal 208 is generated and, in receipt of the rendered image data corresponding to two delay offsets, the firing signal 210 is generated. Thus, the clock signal 204 includes three cycles for each line of printed ink drops. Each line of printed ink drops covers a single pixel on the image receiving member in the process direction. Each of the firing signals 206, 208, and 210 has a duration that corresponds to a single cycle of the clock signal 204. Thus, the inkjets are operated with a firing signal having a frequency that is higher than the frequency at which the firing signal is delivered to the inkjet. That is, a continuous train of firing signals would operate an inkjet at some predetermined frequency, such as 39 KHz, but the periods of a zero firing signal operating the inkjet at a second lower frequency, which in FIG. 2 is 13 KHz.

Because each printed line of pixels on the image receiving member corresponds to three cycles of the operating signal 204, the controller 50 can modify the process direction location of each printed ink drop by one-third of the size of a pixel on the image receiving member. More generally, the controller 50 and printhead controller 712 can modify the process direction locations of ink drops by 1/N pixels in the process direction where N is the multiple of the frequency of delivery of image data to the printhead with reference to the higher frequency of the firing signal to the printhead inkjets. For example, if N=2, then the controller 50 delivers image data at one-half of the firing signal frequency and the controller 50 can modify the location of each ink drop with sub-pixel precision in one-half pixel increments. If N=4, then the controller delivers image data at one-quarter of the frequency of the firing signal to the printhead inkjets and can modify the location of each ink drop with sub-pixel precision in one-quarter pixel increments.

The printer 5 performs process 100 for each printhead in the color units 21A-21D to deliver firing signals to each inkjet during an imaging operation. While the offset values described above in process 100 correspond to integer clock cycles of the operating signal 204, fractional offset values corresponding to one-half clock cycle increments can be used in a printer that is configured to generate firing signals at both the rising and falling edges of the operating signal. In some printer configurations, the modification to the firing signals of the inkjets includes advancing the generation of the firing signal forward in time instead of, or in addition to, delaying the generation of firing signals as depicted in FIG. 2. For example, in the printer 5, the controller 50 advances the operation of an inkjet in the printhead to an earlier time for each printed line if a negative offset value is stored in the memory corresponding to the inkjet.

Figure 3:
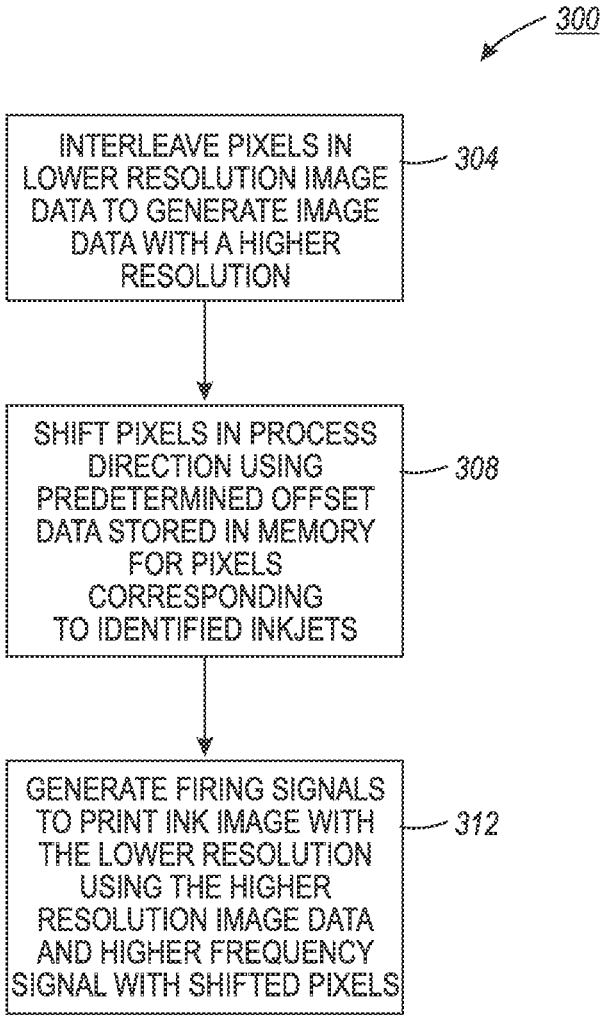
FIG. 3 is a block diagram of a process for modifying image data in an inkjet printer to produce a printed image with improved ink drop placement accuracy in the process direction.

FIG. 3 depicts a process 300 for manipulating image data to enable inkjets in a printhead to produce printed images with reduced drop-placement error in the process direction. In the discussion below, a reference to the process performing a function or action refers to a controller executing programmed instructions stored in a memory to operate one or more components to perform the function or action. The process 300 is described in conjunction with the printer 5 of FIG. 7 for illustrative purposes.

Process 300 begins by interleaving pixels into image data at a first resolution to generate a higher-resolution image (block 304). In the printer 5, the original image data can be stored in the memory 52. The controller 50 interleaves a predetermined number of pixels between adjacent pixels in the original image data to generate the higher resolution image data. The interleaved pixels generated have a value that indicates that the inkjet corresponding to the pixel should not eject an ink drop. Thus, the higher resolution image data do not change the number of ink drops that the inkjets in the printhead eject to form the ink image compared to the original image data.

FIG. 4 depicts an example set of image data as a two dimensional arrangement of pixels. In FIG. 4, each of the pixel columns 416, 420, and 424 corresponds to image data arranged in the process direction P that are generated by a different inkjet in the printhead. The original image data includes rows 404, 408, and 412 arranged in the cross-process direction CP. Prior to interleaving additional pixels, the rows 404, 408, and 412 represent image data with a predetermined resolution in the process direction, such as a resolution of 350 DPI.

The interleaved pixels generated in process 300 are depicted in FIG. 4 as pixel rows 406, 410, and 414. In the example of FIG. 4, two rows of deactivated pixels are interleaved between each succeeding row of activated pixels in the original image data to produce image data with a higher resolution. For example, the two rows of pixels 406 are inserted between the original pixel rows 404 and 408. The effective process-direction resolution of the image data in FIG. 4 is tripled from the original process-direction resolution of the image data. The increase in resolution in the process direction corresponds to the number of interleaved pixels that are inserted between pixels from the original image data. For example, insertion of one row of interleaved pixels between rows of the original image data produces image data with double the resolution of the original image data, and inserting three rows of interleaved pixels between rows of the original image data produces image data with quadruple the resolution of the original image data.

Referring to FIG. 3 and FIG. 4, process 300 continues by shifting selected sets of pixels in the high-resolution image data with reference to predetermined process-direction offsets for individual inkjets (block 308). In the printer 5, the memory 52 stores offset values for image data corresponding to inkjets in the printhead. Each offset value corresponds to a number of pixels that each set of image data are shifted in the higher resolution image data. The controller 50 shifts the image data with reference to the offset values and stores the shifted image data in the memory 52.

In FIG. 4, the column of image data 416 has zero offset, so the pixels such as pixel 428 in column 416 remain in the same location in the process direction. The controller 50 shifts the pixels in column 420 by one pixel in the process direction as depicted by the original pixel 432 and shifted pixel 436. The controller 50 shifts the pixels in column 424 by two pixels as depicted by the original pixel 440 and shifted pixel 444. The shifted pixels effectively introduce a time delay in the initiations of firing signals for inkjets that correspond to the shifted image data because the direction of the shifted image data is opposite the process direction P. For each printed line of an image, firing signals to print unshifted pixels are not delayed, and the delay to the initiation of firing signals increases proportionally with the size of the shift. Thus, the shifted higher resolution image data enables the controller 50 to adjust the process direction registration of printed ink drops on the image receiving member by delivering each line of image data to a printhead controller with reference to clock signal 204 in FIG. 2, which adjusts the generation of firing signals for the inkjets corresponding to a particular delay offset group to compensate for process direction registration errors.

The image data shifting in process 300 does not change the number of activated pixels in the image data, but moves the activated pixels by the predetermined process direction offset instead. Additionally, a minimum of two deactivated pixels remain between activated pixels in each of the image data columns 416, 420, and 424 after the controller 50 shifts the image data. More generally, when I pixels are interleaved between pixels in the original image data to form high-resolution image data, a minimum of I pixels separate activated pixels in the high-resolution image data corresponding to a single inkjet regardless of the amount of shifting.

Process 300 continues as the printer generates firing signals to print an ink image with reference to the shifted image data (block 312). The printer operates in a print mode corresponding to the higher resolution of image data, but the actual density of ink drops that are printed on the image receiving surface corresponds to the original resolution of the image data format. For example, if the original resolution of image data is 350 DPI and process 300 generates higher resolution image data at 1050 DPI, then the printer operates in a print mode for printing 1050 DPI images, but the maximum density of ink drops printed on the image receiving surface is still 350 DPI. The shifted image data enables the printer to apply corrections to the process direction location of ink drops ejected from inkjets in the printhead that are less than the size of a single pixel using the original resolution of 350 DPI.

Processes 100 and 300 are described above with reference to a single printhead for clarity, but printer embodiments that include a plurality of printheads can use processes 100 or 300 to correct for process direction registration errors with inkjets in each of the printheads. While process 100 and 300 are described in conjunction with the direct inkjet printer 5, other printers including indirect inkjet printers can be used with processes 100 and 300 as well.

Both process 100 and process 300 generate improved drop placement accuracy for a printed image at a predetermined resolution by operating the printer in a higher resolution print mode while limiting the firing frequency of individual inkjets so that each inkjet emits ink drops at a lower frequency to print with a predetermined lower resolution. The higher resolution print mode enables the printer to adjust the process-direction registration of ink drops from different inkjets with greater precision to improve the quality of printed ink images.

Figure 5:
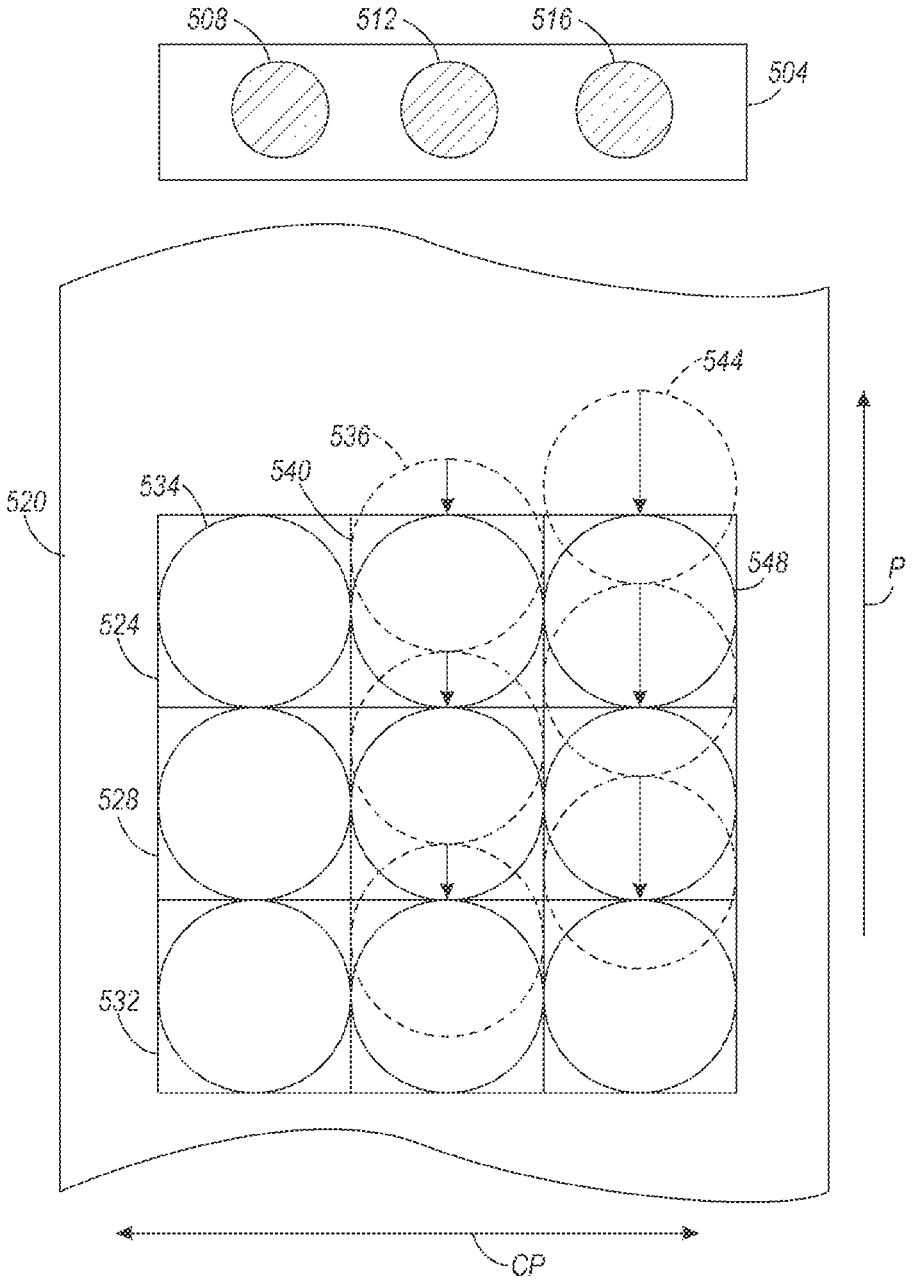
FIG. 5 is a simplified diagram of ink drops formed on an image receiving surface from inkjets that are calibrated to eject ink drops at different times.

FIG. 5 depicts improvements to ink drop placement accuracy in the process direction using process 100. In FIG. 5, a simplified printhead 504 includes inkjets 508, 512, and 516. The inkjets 508-516 eject ink drops onto an image receiving surface of a print medium 520. In FIG. 5, three rows of pixels 524, 528, and 532 represent the intended locations of ink drops in three rows of a printed image extending in the cross-process direction CP. Ink drop 534 from inkjet 508 is registered in the process direction. Misalignment in the inkjets 512 and 516, however, prevents the ink drops from aligning with the ink drop from the inkjet 508 to form a uniform line of ink. For example, location 536 corresponds to an ink drop from the inkjet 512 and location 544 corresponds to an ink drop from the inkjet 516. The process direction misregistration is less than the size of a single ink drop on the print medium. The printer 5 adjusts the process-direction location of the printed ink drops corresponding to inkjets 512 and 516 by less than the size of a single pixel in the printed image at the original resolution. In FIG. 5, the registration of the ink drop 536 is corrected by one-third of a pixel in the process direction to produce registered ink drop 540, and the registration of the ink drop 544 is corrected by two-thirds of a pixel in the process direction to produce registered ink drop 548.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A method of operating a printer comprising:

generating firing signals for inkjets in a printhead, the firing signals corresponding to a first frequency; and initiating the generation of the firing signals to a first plurality of inkjets in the printhead at a second frequency, the first frequency being greater than the second frequency.

2. The method of claim 1 further comprising:

modifying a time for initiating the generation of the firing signals to the first plurality of inkjets with reference to a multiple of a period of the first frequency.

3. The method of claim 2 wherein the second frequency is half the first frequency.

4. The method of claim 2 wherein the second frequency is one third of the first predetermined frequency.

5. The method of claim 2 further comprising:

modifying the time for initiating the generation of the firing signals to the first plurality of inkjets to correct a process direction placement error associated with the inkjet.

6. The method of claim 5 further comprising:

storing a time offset value in a memory of the inkjet printer with reference to the process direction placement error associated with the first plurality of inkjets.

7. The method of claim 2, the initiation of the firing signal generation to the first plurality of inkjets further comprising:

delaying the time of delivery of the firing signals to the first plurality of inkjets by an amount of time that is less than one period of the second frequency.

8. The method of claim 2, the initiation of the firing signal generation to the first plurality of inkjets further comprising:

advancing the time of initiation of the generation of the firing signals to the first plurality of inkjets by an amount of time that is less than one period of the second frequency.

9. The method of claim 1 wherein the first frequency is an integral multiple of the second frequency.

10. An inkjet printer comprising:

an image receiving member having an image receiving surface;

a printhead including a plurality of inkjets, each inkjet in the plurality of inkjets being configured to eject an ink drop onto the image receiving surface in response to a firing signal;

a printhead controller operatively connected to the plurality of inkjets in the printhead and configured to:

generate firing signals for inkjets in a printhead with reference to rendered image data, the firing signals corresponding to a first frequency; and initiate the generation of firing signals to a first plurality of the inkjets in the printhead at a second frequency, the first frequency being greater than the second frequency;

an actuator configured to move the image receiving surface past the printhead in a process direction; and a controller operatively connected to the printhead controller, actuator, and a memory, the controller being configured to:

operate the actuator to move the image receiving surface past the printhead in the process direction at a predetermined rate; and send the rendered image data to the printhead controller.

11. The inkjet printer of claim 10, the printhead controller being further configured:

modify a time for initiating generation of the firing signals to the first plurality of inkjets with reference to a multiple of a period of the first frequency.

12. The inkjet printer of claim 11, the printhead controller being further configured to:

modify the time for initiating generation of the firing signals to the first plurality of inkjets to correct a process direction placement error associated with the first plurality of inkjets.

13. The inkjet printer of claim 12, the printhead controller being further configured to:

store a time offset value in a memory associated with the printhead with reference to the process direction placement error associated with the first plurality of inkjets.

14. The inkjet printer of claim 11, the printhead controller being further configured to modify the time for initiating the generation of the firing signals by:

delaying the time of initiating generation of the firing signals to the first plurality of inkjets by an amount of time that is less than one period of the second frequency.

15. The inkjet printer of claim 11, the printhead controller being further configured to modify the time for initiating the generation of the firing signals by:

advancing the time of initiating generation of the firing signals to the first plurality of inkjets by an amount of time that is less than one period of the second frequency.

16. The inkjet printer of claim 10 wherein the first frequency is an integral multiple of the second frequency.

17. The inkjet printer of claim 10 wherein the first frequency is twice the second frequency.

18. The inkjet printer of claim 10 wherein the first frequency is three times the second frequency.

19. The inkjet printer of claim 10, the controller being further configured to:

send only a portion of the rendered image data to the printhead controller during each cycle of the first frequency, the portion of the rendered image data being selected with reference to a plurality of offset values corresponding to the plurality of inkjets in the printhead and stored in the memory.

20. The inkjet printer of claim 10, the controller being further configured to:

generate rendered image data for the printhead controller including a plurality of rasterized pixel rows arranged in a cross-process direction and columns arranged in the process direction;

interleave at least one row of deactivated pixels between each of the plurality of rasterized pixel rows;

shift at least one column of the rendered image data in the process direction with reference to an offset value stored in the memory; and send each pixel row in the plurality of pixel rows of the rendered image data to the printhead controller at the first frequency.

* * * * *